United States Patent [19]

Birk et al.

[11] 4,346,504

[45] Aug. 31, 1982

[54] YARN FORWARDING AND DRAWING APPARATUS

[75] Inventors: Manfred O. Birk, Spartanburg; Wolfgang A. Piesczek, Inman; Brian E. Little, Spartanburg, all of S.C.

[73] Assignee: Hoechst Fibers Industries, Spartanburg, S.C.

[21] Appl. No.: 168,654

[22] Filed: Jul. 11, 1980

[51] Int. Cl.[3] ..... D01D 5/12; D02J 1/22

[52] U.S. Cl. ..... 28/240; 19/299; 156/167; 264/290.5; 264/555; 425/66

[58] Field of Search ..... 19/299; 28/240, 254, 28/255, 257, 272, 273, 274, 276, 283; 264/290.5, 555; 226/97; 425/66, DIG. 17; 156/167

[56] References Cited

U.S. PATENT DOCUMENTS

| | | | |
|---|---|---|---|
| 2,379,824 | 7/1945 | Mummery . | |
| 2,411,660 | 11/1946 | Manning . | |
| 2,437,263 | 3/1948 | Manning . | |
| 2,447,982 | 8/1948 | Koster . | |
| 2,622,961 | 12/1952 | Finlayson . | |
| 2,638,146 | 5/1953 | Rounseville et al. . | |
| 2,736,676 | 2/1956 | Frickert, Jr. . | |
| 2,875,503 | 3/1959 | Frickert et al. . | |
| 2,885,257 | 5/1959 | Courtney et al. . | |
| 2,924,868 | 2/1960 | Dyer . | |
| 2,971,243 | 2/1961 | Burns . | |
| 2,971,683 | 2/1961 | Paulsen . | |
| 2,982,000 | 5/1961 | Gonsalves | 28/254 |
| 3,094,262 | 6/1963 | Ashby et al. . | |
| 3,156,395 | 11/1964 | Ashby et al. . | |
| 3,175,290 | 3/1965 | Bunting, Jr. et al. . | |
| 3,259,952 | 7/1966 | Caines . | |
| 3,286,896 | 11/1966 | Kinney . | |
| 3,297,506 | 1/1967 | Pannill, Jr. et al. | 28/283 X |
| 3,302,237 | 2/1967 | Cope et al. . | |
| 3,314,840 | 4/1967 | Lloyd et al. . | |
| 3,325,906 | 6/1967 | Franke . | |
| 3,334,161 | 8/1967 | De Guzman . | |
| 3,338,992 | 8/1967 | Kinney | 264/290.5 X |
| 3,341,394 | 9/1967 | Kinney . | |
| 3,364,538 | 1/1968 | Murphy . | |
| 3,423,000 | 1/1969 | Heinen . | |
| 3,423,266 | 1/1969 | Davies et al. . | |
| 3,453,709 | 7/1969 | Dyer . | |
| 3,485,428 | 12/1969 | Jackson . | |
| 3,490,219 | 1/1970 | Ozawa et al. | 28/273 X |
| 3,559,860 | 2/1971 | East et al. . | |
| 3,576,058 | 4/1971 | Berg et al. | 28/255 |
| 3,576,284 | 4/1971 | Fellous et al. . | |
| 3,577,614 | 5/1971 | Price . | |
| 3,645,431 | 2/1972 | Harrison . | |
| 3,655,862 | 4/1972 | Dorschner et al. . | |
| 3,683,732 | 8/1972 | Juppet . | |
| 3,684,143 | 8/1972 | Juppet . | |
| 3,690,530 | 9/1972 | Porter . | |
| 3,692,618 | 9/1972 | Dorschner et al. . | |
| 3,698,610 | 10/1972 | Feltgen et al. . | |
| 3,703,754 | 11/1972 | Blanc et al. . | |
| 3,736,211 | 5/1973 | Lipscomb et al. . | |
| 3,754,694 | 8/1973 | Reba . | |
| 3,773,483 | 11/1973 | Schmidt . | |
| 3,798,100 | 3/1974 | Marchadier et al. . | |
| 3,802,817 | 4/1974 | Matsuki et al. | 19/299 X |
| 3,853,651 | 12/1974 | Porte . | |
| 3,895,420 | 7/1975 | Strutz et al. . | |
| 3,923,587 | 12/1975 | Porte . | |
| 3,945,545 | 3/1976 | Bacro . | |
| 3,956,807 | 5/1976 | Holland | 28/255 |
| 3,970,231 | 7/1976 | Strutz et al. . | |
| 3,982,412 | 9/1976 | Isoard et al. . | |
| 4,040,154 | 8/1977 | Riley | 28/273 X |
| 4,114,790 | 9/1978 | Sighieri et al. . | |
| 4,181,247 | 1/1980 | McFall . | |

FOREIGN PATENT DOCUMENTS

| | | | |
|---|---|---|---|
| 48-16138 | 5/1973 | Japan | 28/276 |
| 932482 | 7/1963 | United Kingdom . | |

*Primary Examiner*—Robert Mackey

*Attorney, Agent, or Firm*—Wellington M. Manning, Jr.; Luke J. Wilburn, Jr.

[57] ABSTRACT

An improved fluid operated forwarding and drawing apparatus for continuous filamentary materials including a jet nozzle structure defined by a fluid outlet port from a fluid plenum chamber and a filament guide tube where the nozzle has a converging acceleration zone, a throat, a diverging expansion zone and a converging transition zone. A small diameter friction tube abuts an exit to the transition zone. The device is adjustable during set up and operation whereby close manufacturing tolerances are not required and operating parameters of the nozzle may be easily varied. The device is operable at low air pressures, low air consumption and low noise levels while handling filamentary materials at high linear velocities. A process for drawing and forwarding filamentary materials is also disclosed.

40 Claims, 5 Drawing Figures

YARN FORWARDING AND DRAWING APPARATUS

BACKGROUND OF THE INVENTION

Fluid operated devices have been utilized in the textile industry for a number of years as a means for forwarding and processing continuous filamentary materials. Design of such prior fluid operated devices has, in general, been dictated by the intended use of the device. For example, hand held aspirators have been utilized to forward filaments at high speeds from a source adequate to operatively associate the filaments with further processing apparatus operating at high speeds or to waste, such that the source continues to function at normal rates and that sudden shock is not imparted to the filaments adequate to rupture same. Likewise, fluid jet devices have been employed in conjunction with synthetic filamentary materials, normally in the form of yarn bundles, to forward the yarn, to entangle or interlace filaments of the bundle for a particular appearance or physical characteristic, or to texturize or bulk the filaments.

In similar fashion, fluid jet structures have heretofore been utilized to both forward and attenuate thermoplastic filaments of a yarn bundle, preparatory to deposition of the yarn bundle onto a moving substrate, for formation of a nonwoven web. The web is then calendered or otherwise treated to unify same into a coherent structure. One particular type of process for so forming a nonwoven web is referred to as a "spunbond" process which involves deposition of filamentary materials onto a support surface without intermediate collection of the materials, and it is this particular type of process for which the improved yarn forwarding and drawing apparatus of the present invention is particularly suited. Fluid jet structures that have been utilized for the drawing and forwarding of thermoplastic filamentary materials in a spunbond type process are exemplified by U.S. Pat. Nos. 3,655,862 to Dorschener et al; 3,576,284 to Fellous et al; 3,754,694 to Reba; and 3,736,211 to Lipscomb et al.

A number of fluid devices are normally employed at adjacent spinnerettes along a melt spinning apparatus, with the combined filamentary output through the adjacent devices spanning the width of the web to be formed. Overall uniformity of physical characteristics of the filaments being deposited is important to production of a uniform web. Heretofore, fluid drawing and forwarding devices have, of necessity, been manufactured within very close tolerances, attempting to produce precision devices through which filaments of uniform physical properties are processed. Trial and error and/or selection techniques have generally been necessary, however, attempting to match such precision devices, without totally satisfactory results. Oftentimes, for example, particular units have been discarded due to inability to process filaments that exhibit physical properties within the specification ranges for same.

Prior art fluid operated devices for forwarding and/or other processing of filamentary yarns have employed a venturi of Laval type nozzle structure. Yarn is presented in a yarn passageway of a guide tube that is centrally located with respect to the nozzle structure with the tip of the yarn tube residing in and cooperating with the structure to provide an aspirating nozzle. Primary pressurized fluid passing through the nozzle structure aspirates atmospheric air through the guide tube to entrain and forward the yarn, while the primary fluid acts on the yarn in its intended manner, to interlace, bulk, texturize, attenuate or otherwise affect the filaments. Primary fluid flow has been generally turbulent or nonturbulent, depending upon whether the filaments are to be tangled or parallel. In general, however, such devices are deficient or inefficient in some respect, such as noise level during operation, requirements for high fluid pressures, high fluid consumption, inability to process yarns traveling at high linear velocities, unreasonable manufacturing tolerances, lack of uniformity of filaments processed through adjacent devices, and the like.

Fluid operated devices for both forwarding and drawing organic filamentary yarns according to the present invention, achieve the intended results without experiencing the deficiencies or inefficiencies noted above. Numerous significant parameters have been considered and are achievable by the device and process of the present invention. Filaments up to 15 denier and filament bundles up to 1500 total denier may be satisfactorily forwarded and drawn at linear velocities through the device up to about 7500 meters per minute. At operating speeds of the magnitude mentioned above, the bundle is forwarded and drawn without entanglement or interlacing of the filaments. The yarn bundle does not make any significant contact with the side walls of the friction tube. The devices are capable of accurate adjustment during operation which permits matching of devices located at a plurality of adjacent extrusion positions which supply filaments for the width of a web to be formed. The apparatus operates satisfactorily at low air pressures, low air consumption, and at low noise levels. Good aspiration of secondary air and attainment of adequate tensioning on the filaments for drawing are simultaneously achieved. Components of the devices are interchangeable.

The device and method according to teachings of the present invention accomplish the aforestated results and operational characteristics. Clearly such represents significant technological improvement over prior devices and techniques. The known prior art neither teaches nor suggests the novel structure or process according to the present invention.

SUMMARY OF THE INVENTION

It is an object of the present invention to provide an improved fluid yarn forwarding and drawing apparatus that continuously achieves good aspiration of secondary air for forwarding a yarn and tensioning of the yarn adequate to attenuate same at desired draw ratios.

Another object of the present invention is to provide a yarn forwarding and drawing apparatus that is capable of handling bundles of multifilament, thermoplastic yarns at high yarn speeds without entanglement of the filaments, while consuming low quantities of a pressurized fluid.

Still further another object of the present invention is to provide an improved fluid yarn forwarding and handling device that is capable of operating at low fluid pressures, low fluid consumption, and at low noise levels while forwarding and attenuating multifilament synthetic yarns traveling at high linear velocities.

Yet further, another object of the present invention is to provide an improved fluid yarn forwarding and drawing apparatus that is capable of adjustment during operation to permit positional matching of yarn filament properties, and in which component parts are interchangeable.

Yet another object of the present invention is to provide an improved fluid yarn forwarding and drawing apparatus where fluid back pressure generated in the apparatus does not significantly decrease strength of aspiration of secondary air.

Still further, another object of the present invention is to provide an improved process for forwarding and drawing multifilament thermoplastic yarns traveling at high linear velocities without entanglement of the filaments, and subsequent random deposition of the filaments onto a moving surface to produce a coherent nonwoven web thereof.

Another object of the present invention is to provide an improved process for fluid forwarding and handling of multifilament yarns for use in the formation of a nonwoven web or the like, which process utilizes low fluid pressures and low fluid consumption and operates at low noise levels.

In general, the present fluid apparatus for forwarding and drawing multifilament yarns comprises a body, said body defining a fluid plenum chamber therein, said body further defining fluid inlet ports and a generally funnel shaped fluid outlet port in communication with said plenum chamber and a bore opening in communication with said plenum chamber and located concentric to a central axis through said fluid outlet port; tubular yarn guide means received in said bore opening, and terminating in said generally funnel shaped fluid outlet port of said plenum chamber, at least a portion of the length of said tubular guide means being generally frustoconically tapered to a terminal end of said means, whereby said frustoconically tapered means cooperates with said generally funnel shaped fluid outlet port to define a nozzle structure having a fluid acceleration zone, a throat and an expansion zone, and said port further defines a converging fluid transition zone beyond the end of said yarn guide means; and an elongated tubular element located at an outer end of said converging transition zone and defining a yarn passageway therethrough that is concentric to said central axis of said outlet port and in communication with said transition zone.

More particularly, the body of the fluid device according to the present invention is preferably cylindrical in nature, and defines a fluid plenum chamber therein to which fluid under pressure is admitted through fluid ports that are equidistantly spaced around the body. Internal surfaces of the plenum chamber are smooth such that pressurized fluid admitted to and maintained within the chamber is in a generally non-turbulent condition, whereby fluid velocity at the entrance to the fluid outlet port is very low, preferably as close to zero as possible. In a most preferred arrangement, a smooth surfaced generally conical protrusion extends downwardly into the plenum chamber, being centrally located with respect thereto, and through which the bore opening extends.

The yarn guide means received in the bore opening preferably takes the form of an elongated tubular element that defines a yarn passageway therealong. A frustoconical taper is provided along a portion of the length of the tubular element, preferably beginning in the plenum chamber and terminating at the terminal tip of the element within the fluid outlet port. An opposite, outer end of the yarn guide tube is provided with a generally funnel shaped yarn entrance surface, which, in a most preferred embodiment has a trumpet shape as illustrated in the Figures.

The particular configuration of the fluid outlet port cooperates with the tapered surface of the guide means received therein to define a particular fluid nozzle arrangement. In particular, the outlet port assumes a generally funnel shape, preferably a trumpet shape as illustrated in the Figures having a series of annular edges along the surface of same. With the guide tube inserted therein, a nozzle throat is formed at the point of smallest cross sectional area between the port walls and the surface of the tube. A fluid acceleration zone is defined upstream of the throat with walls of the port converging toward the throat, preferably in the series of steps defined by the annular edges. Immediately downstream of the throat is a diverging expansion zone which extends from the throat to the tip of the guide tube (hereinafter also referred to as the orifice plane of the guide tube). A converging transition zone is defined by the port walls downstream of the orifice plane of the tube and extends to a juncture point with a larger inner diameter, elongated friction tube.

The converging transition zone is a particularly important aspect of the present invention, which in cooperative association with other related structural features, permits successful operation of the device over wide operational ranges and conditions.

Devices according to the present invention are adjustable during operation and capable of component interchange or replacement. Individual units may thus be positionally matched to adjacent units whereby uniform physical characteristics of filaments may easily be achieved across the width of a web formed therefrom. In a preferred fluid device, the body of same includes an upper body portion that defines the central bore, a majority of the plenum chamber, and the fluid inlet ports, and a bottom plate adjustably secureable to the upper portion. The bottom plate defines the bottom wall of the plenum chamber and the fluid exit port, and the adjustability permits concentricity between the bore opening and a central axis through the fluid exit port to be realized without the necessity of employing extremely close manufacturing tolerances during manufacture of the device. The yarn guide tube is adjustably receivable within the bore opening for limited axial adjustment without a loss of concentricity, whereby the particular nozzle characteristics may be varied to achieve positional matching as discussed above, or certain operating parameters for the device.

The improved process according to the present invention generally includes the steps of smoothly accelerating a primary pressurized fluid to sonic velocity in a throat of an aspirating nozzle; smoothly expanding said sonic velocity fluid to a supersonic velocity in a diverging expansion zone; passing said fluid through a transition zone downstream of an orifice plane of a yarn guide tube located within said throat and expansion zone, whereby a low absolute pressure is established at said orifice plane adequate to aspirate a secondary fluid through a yarn passageway in said yarn guide tube; introducing a bundle of organic thermoplastic filaments into said yarn passageway of said guide tube, where said filaments are entrained in said secondary fluid and are forwarded along said yarn guide tube beyond the orifice plane of said tube; further contacting said bundle of filaments with a generally parallel flow of said primary fluid in said transition zone; and introducing said filaments, and said primary and secondary fluids into an elongated friction tube, the inner diameter of which is larger than the inner diameter of an exit from the transition zone, and maintaining primary fluid velocity at a subsonic level above the linear velocity of said filaments adequate to impart sufficient skin shear forces on the individual filaments to attenuate same, without filament entanglement.

More particularly, in practicing the process according to the above recited steps, it is possible to forward and attenuate a thermoplastic synthetic polymeric filamentary material without entanglement of filaments within a filament bundle under fluid operating conditions where the primary fluid pressure is generally low, fluid consumption is low, and noise level of the operation is low.

DESCRIPTION OF THE PREFERRED EMBODIMENTS

Making reference to the Figures, preferred embodiments of the present invention will now be described in detail.

Figure 1:
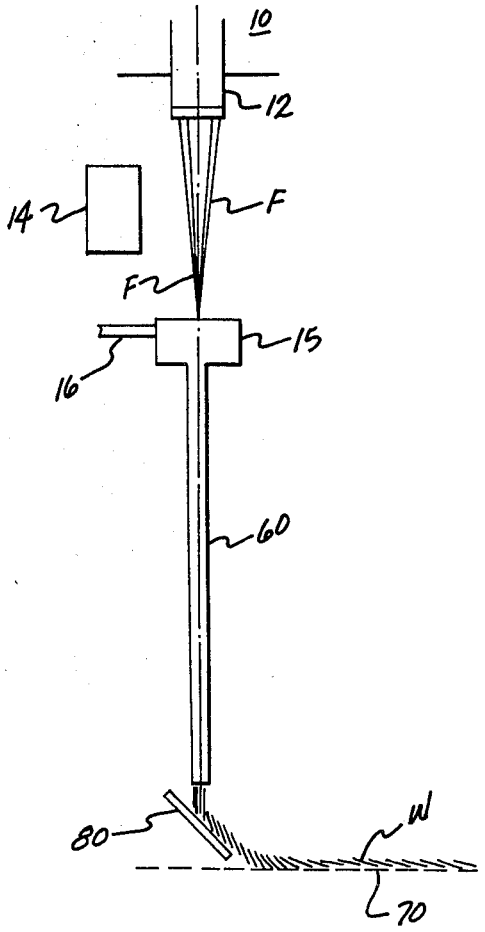
FIG. 1 is a schematic illustration of a process for the manufacture of a nonwoven web of filamentary material according to teachings of the present invention.

In FIG. 1, the process of the present invention is schematically illustrated for the production of a nonwoven web of the type that is sometimes referred to as a "spunbonded" product. Synthetic polymeric filaments F, such as polyester filaments that are thermoplastic in nature, are manufactured in an appropriate and conventional apparatus generally indicated as 10, with a plurality of filaments F emerging from a spinnerette 12. At some particular location downstream from spinnerette 12, filaments F, in bundle form, are subjected to a cooling medium schematically illustrated as 14 which cools the filaments adequate to change same from a generally molten to a solid state. Cooling medium 14 is only schematically illustrated, in that, such techniques are well known in the art. A cooling, or quench of the filaments may be accomplished by passage of same through ambient air, or a particular device for directing a fluid into contact with the filaments to cool and solidify same.

Located along the path of the filament bundle, and preferably concentric with a central axis through the spinnerette is a yarn forwarding and drawing apparatus generally indicated as 15 that is, in part, the subject matter of the present invention. The yarn forwarding and drawing apparatus 15, as is particularly described hereinafter, receives a primary pressurized fluid from a controlled supply 16, which fluid passes through apparatus 15 in a particular fashion to aspirate atmospheric air into the device with filaments F entrained therein and transported thereby. Located below fluid forwarding and drawing apparatus 15 is an elongated friction tube generally indicated as 60, which in essence, though given a separate numerical connotation for sake of clarity, should be considered to be an integral element of the overall drawing and forwarding apparatus 15. Filaments F are thus aspirated through fluid operated device 15 and introduced into elongated friction tube 60 where the velocoity of the primary fluid with respect to the linear velocity of the filaments passing therethrough is of adequate magnitude that the filaments are subjected to skin shear forces adequate to attenuate same to a "drawn" state, while at the same time, avoiding any significant entanglement of the individual filaments of the bundle and avoiding contact between the interior walls of the friction tube and the filament bundle. When so processed, the filament bundle exits from the friction tube 60 in a state of openness or filament parallelity and separation adequate for proper deposition onto a moving support surface 70 for subsequent formation of a nonwoven web W.

The filament bundle exits the friction tube 60 at a linear velocity of up to 7500 meters per minute. In order to achieve a random, but uniform distribution of filaments across the width of moving support surface 70, it is desirable to intercept the flow of fluid and filament bundle exiting friction tube 60 with a deflector means 80, schematically shown at an angle to the path of filament travel.

As to the means for deflecting the filament bundle for a proper lay on moving support surface 70, numerous types of deflector plates have heretofore been devised which may be adapted to use in the process according to the present invention. Such deflectors have been represented by stationary plates at particular angular relationships, oscillating plates, rotating plates, reciprocating plates and the like, each of which may be utilized to achieve a particular lay down of the filament bundle onto the moving support surface 70. It is of course important to locate the individual filaments on the moving support surface 70 in a predetermined fashion while also achieving uniform filament density, etc. across the width of the web. Subsequent to deposition of the filaments onto moving support surface 70, the web W may then be unified into a coherent structure by any suitable means, such as calendering to thermally bond filaments at crossing points, needle punching, application of adhesive thereto, or the like, all of which are well known in the art and do not, per se, form a part of the present invention.

Figure 2:
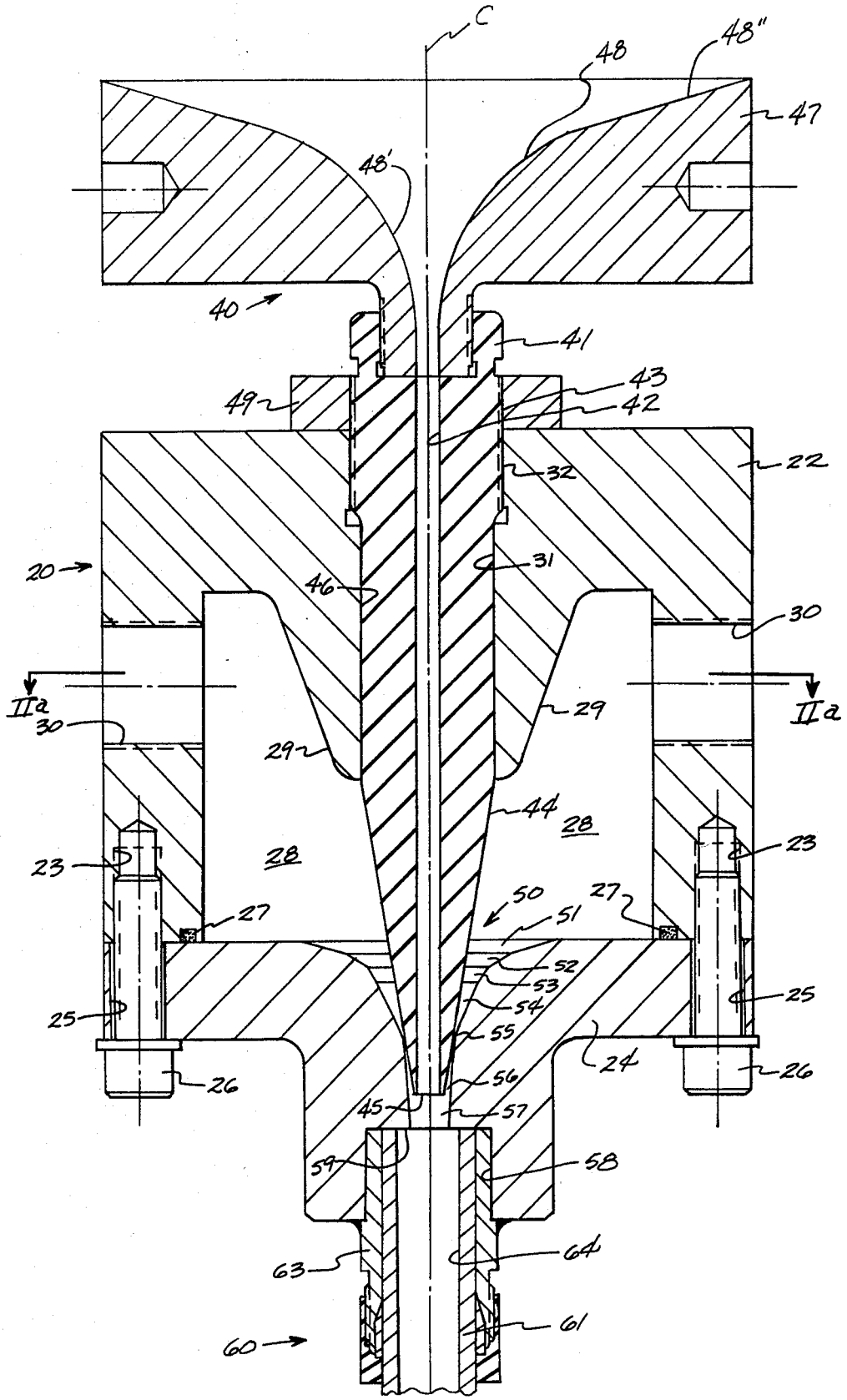
FIG. 2 is a vertical cross sectional view of a preferred device for forwarding and drawing filamentary materials according to teachings of the present invention.
Figure 2A:
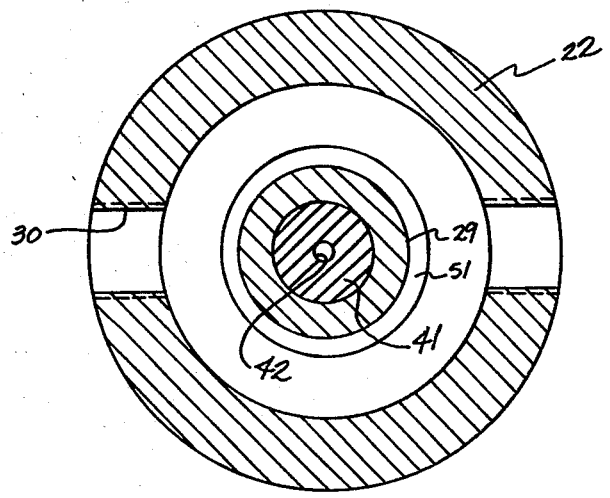
FIG. 2A is a horizontal cross sectional view of the device as illustrated in FIG. 1, taken along a line IIa—IIa.
Figure 3:
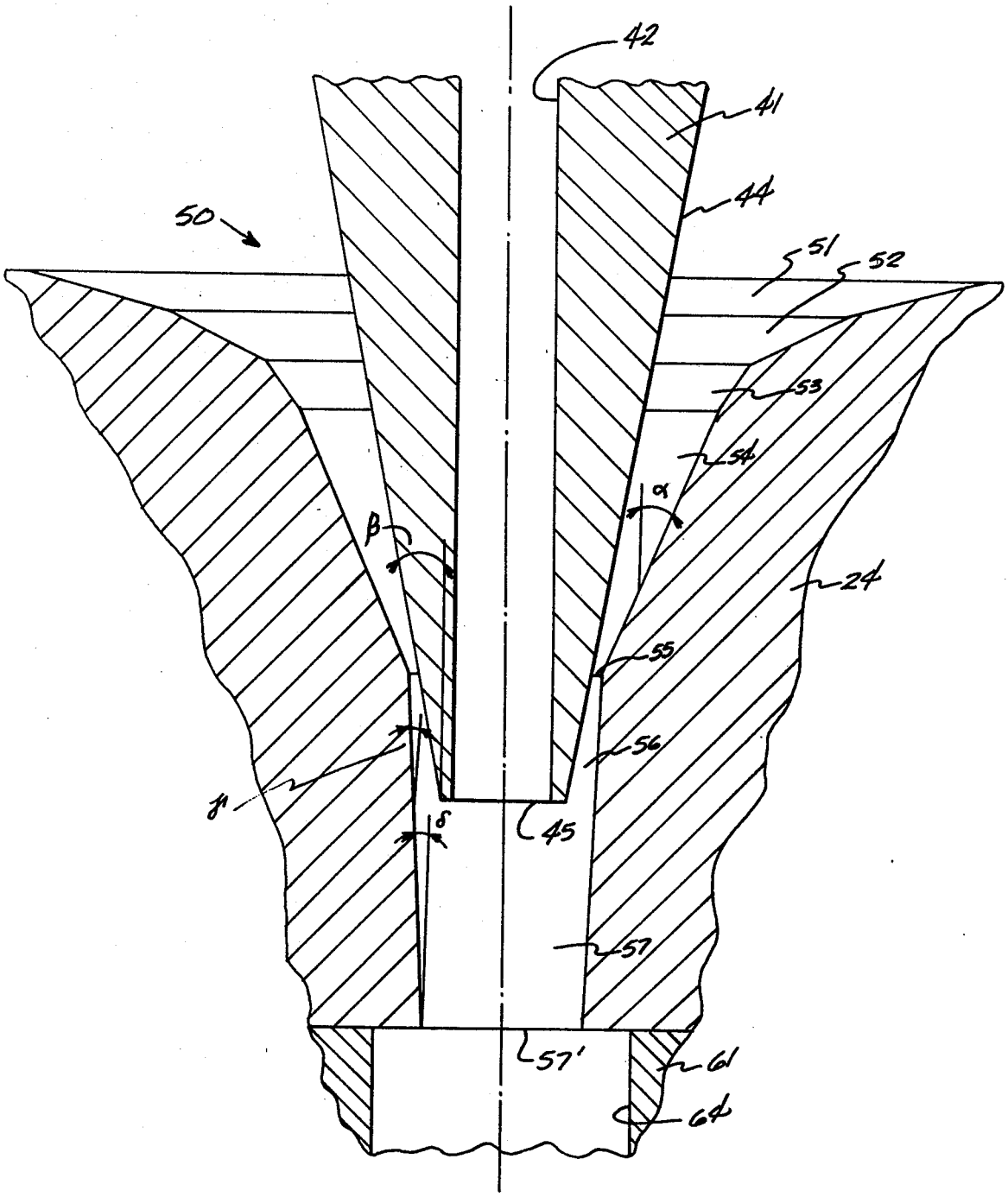
FIG. 3 is a partial vertical cross sectional view of the device of FIG. 1 illustrating the aspirating nozzle in more detail.

In carrying out the improved process for producing a nonwoven web according to teachings of the present invention, fluid devices of a particular construction should be utilized. A preferred embodiment of such a fluid yarn forwarding and drawing apparatus is illustrated in FIGS. 2 through 3. A fluid jet body generally indicated as 20 is provided having a yarn guide means generally indicated as 40 associated therewith to receive and direct yarn through the device in a particular fashion, and an elngated friction tube means generally indicated as 60 received in fluid communication with an end of jet body 20 through which the filament bundle exits.

Jet body 20 preferably includes an upper body portion 22 and a bottom plate portion 24 that is adjustably secureable to upper body portion 22 by a plurality of fastening members such as bolts 26. Fastening members 26 are loosely received through openings 25 defined by bottom plate 24 and in threaded connection with threaded openings 23 that are provided in upper body portion 22. With bottom plate 24 secured to upper body portion 22, jet body generally 20 defines a fluid plenum chamber 28 with a generally conical shaped segment 29 of body portion 22 extending downwardly therein. Sealing means 27 seals plenum chamber against fluid leakage. A plurality of fluid inlet ports 30 for chamber 28 are defined by upper body portion 22, with ports 30 preferably being spaced equidistantly around body 20 to facilitate parallel fluid flow into plenum chamber 28.

Upper body portion 22 of jet body 20 further defines a central bore opening 31 extending from an utmost portion of same downwardly into plenum chamber 28. Bore opening 31 has a threaded section 32 adjacent an upper end of same with the remaining surfaces from threaded section 32 down into plenum chamber 28 being ground within very close tolerances, the purpose of which will be discussed in detail hereinafter. In addition to providing a bottom wall surface for plenum chamber 28, bottom jet body plate 24 further defines a fluid exit port generally indicated as 50 which will be described in particular detail hereinafter.

A yarn guide means 40 is associated with jet body 20, a portion of which extends through bore opening 31, plenum chamber 28, and into fluid exit port 50. Yarn guide means 40 generally includes an elongated tubular guide element 41 that defines a centrally located yarn passageway 42 therethrough and a yarn inlet tube 47 secured to a portion of element 41 without body 20. An upper portion of tubular element 41 is provided with a threaded section 43 that mates with the threaded section 32 of bore opening 31, while a lower portion of yarn guide element 41 has a frustoconical tapered section 44, which taper preferably begins at a portion of element 41 received within chamber 28 and continues to the terminal tip (orifice plane) of guide element 41 from which yarn exits. Intermediate the length of yarn guide element 41, is an area between threaded section 43 and the frustoconical section 44, the outer surface 46 of which is ground within close tolerances to mate with the ground surfaces of bore opening 31 as discussed above. Located atop yarn guide element 41 is yarn inlet tube 47 which has a trumpet shaped yarn contact area 48 that reduces in size to the diameter of yarn passageway 42. Yarn inlet tube 47 is preferably an independent part that is threadably secured to yarn guide tube 41, with yarn contact area becoming a continuation of yarn passageway 42 at the junction between inlet tube 47 and element 41. While a generally funnel shaped yarn contact surface is generally satisfactory for the yarn inlet tube 47, a preferred trumpet shaped surface is illustrated. A trumpet shaped surface 48, enables yarn bundles to be easily introduced at the throat 48' of the trumpet during initial lace up where aspiration forces are stronger. With a conventional funnel shape, though operative, the throat of the funnel is deeper and thus less accessible for easy yarn lace up procedures. Further, a trumpet shape as illustrated includes a generally flattened area 48'' which provides adequate slope that individual trailing filaments which have broken from the bundle during operation will make contact therewith and slide inwardly to throat 48' where they become reaspirated into the device.

As illustrated in FIG. 2, yarn guide element 41 extends through plenum chamber 28 and terminates within fluid outlet port 50 of jet body plate 24. Location of terminal tip (orifice plane) 45 of guide element 41 within outlet port 50 controls operational parameters of a jet nozzle cooperatively defined by frustoconical surface 44 of guide element 41 and surfaces of fluid outlet port 50. As mentioned above, it is important that the apparatus of the present invention be adjustable to permit positional matching of adjacent devices at a number of extrusion positions supplying filaments for the width of a single web to control physical properties of the filaments within appropriate specification ranges.

At the time bottom plate 24 is secured to upper body portion 22 of jet body 20, a certain degree of lateral movement of plate 24 is permissible since openings 25 through which bolts 26 pass are larger than the diameter of bolts 26. With plate 24 thus loosely secured to upper body portion 22, (bolts 26 are in threaded engagement, but not tightened), plate 24 may be moved laterally with respect to upper body portion 22 to accurately align fluid exit port 50 concentric to a center line C passing through bore opening 31. Such alignment is practically achieved by seating tip 45 of guide tube 41 into light contact with port 50. Once the proper concentric alignment is achieved, fastening members 26 may be tightened to secure the concentric alignment. Yarn guide tube 41 received in bore opening 31 is likewise concentric to center line C and thus also fluid exit port 50 due to the close tolerances of the mating ground surface in bore opening 31 and guide element 41. Mating threaded portions 43 and 32 of guide tube 41 and upper body portion 22 respectively, enable guide tube 41 to be accurately moved inwardly or outwardly with respect to fluid exit port 50 whereby orifice plane 45 of guide tube 41 may be located within fluid port 50 to achieve certain operational parameters for the nozzle. A lock nut 49 is threadedly received around the outer upper end of yarn guide tube 41 and when tightened against body portion 22 secures the positional relationships between guide tube orifice plane 45 and fluid exit port 50. Should it thereafter become necessary to readjust the device, lock nut 49 is loosened, guide means 40 adjusted up or down as desired, and lock nut 49 is retightened. Again, concentricity is retained as a result of the mating ground surfaces mentioned above.

Figure 4:
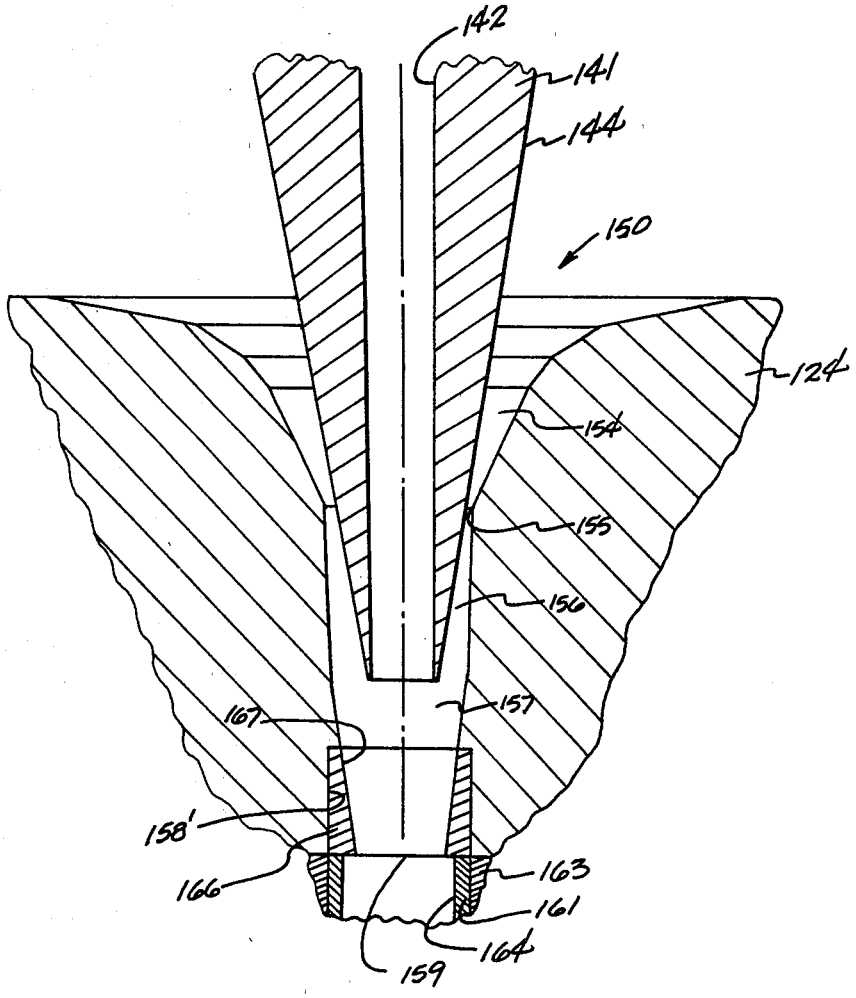
FIG. 4 is a partial vertical cross sectional view of a portion of the yarn forwarding and drawing apparatus as shown in FIG. 1, illustrating a further embodiment of same.

With yarn guide means 40 in the desired position, frustoconical surface 44 and tip 45 assume a particular relationship to exit port 50 to define a fluid nozzle structure therebetween. Fluid outlet port 50 has a generally funnel shaped surface, most preferably trumpet shaped as illustrated in FIGS. 2, 3 and 4, the side walls of which are annularly segmented to provide segments 51, 52, 53 and 54 with each two adjacent segments having an annular edge therebetween. Segments 51 through 54 in cooperative association with the tapered outer surface 44 of guide tube 41 define a fluid acceleration zone that terminates at a throat 55 which, by definition, is the smallest cross sectional area between the walls of exit port 50 and the surface of yarn guide tube 41. Downstream of throat 55, the walls of exit port 50 and element 41 define a diverging expansion zone 56 which extends from throat 55 to orifice plane 45 of guide tube 41. Below orifice plane 45, exit port 50 defines a converging fluid transition zone 57 which may be a continuation of the convergence of the port walls within expansion zone 56, or may have a different angle of convergence. Fluid transition zone 57 terminates at the entrance to friction tube means generally indicated as 60.

As illustrated in FIG. 2, a recess 58 is provided in plate 24 having a sleeve 63 received therein. Elongated tubular friction element 61, having an internal yarn passageway 64 therein is secured within sleeve 63, abutting plate 24 at an exit plane 59 of transition zone 57. In all instances, the inner diameter of friction element 61 is larger than the diameter of fluid transition zone 57 at exit plane 59, and has a constant inner diameter throughout its length. Generally speaking, friction tube means preferably vary in length from about 2 to about 4 meters with an inner diameter that preferably is as small as possible without generation of excessive back pressure therein and without undue confinement of the filament bundle.

Making additional reference to FIG. 3, particular features of the fluid nozzle described above will be discussed in detail. In particular, in the situation where the acceleration zone is a simple funnel, a generating angle ($\alpha$) of between about 10 and about 40 degrees is preferred. In the embodiment where a trumpet shaped nozzle inlet is utilized, a generating angle ($\alpha$) between a line tangent to segment 54, and the vertical center line C is from about 10 to about 30 degrees, and preferably from about 15 to about 25 degrees. The generating angle ($\beta$) of frustoconical surface 44 of guide tube 41 should be as small as possible to avoid entanglement of filaments and reduce energy loss in the jet. Cone angles ($\beta$) in a range of about 5 to about 15 degrees are suitable. The resulting convergence angle ($\alpha$-$\beta$) of the acceleration zone 54 should be no larger than about 20 degrees in a preferred arrangement. The generating angle ($\gamma$) of the wall of port 50 within expansion zone 56 should be determined by the generating angle ($\beta$) of frustoconical section 44 of guide tube 41, and the overall length of expansion zone 56. Particularly, a generating angle ($\gamma$) of port walls within expansion zone 56 should preferably be selected to achieve a ratio of annular cross sections of the outlet of the expansion zone 56 to the inlet of the expansion zone 56 of not less than about 2.0. An expansion zone 56 characterized by such a ratio affords satisfactory aspiration for the full general operating range of the jet device. Further, to minimize the angle of impingement of primary fluid on the filaments, generating angle ($\gamma$) of the port walls within expansion zone 56 should always be less than the frustoconical angle ($\beta$) and should generally not exceed about 10 degrees. With such conditions, a resulting divergence angle of the expansion zone 56 ($\beta$-$\gamma$) may generally vary from about 5 to about 15 degrees, and preferably from about 5 to about 10 degrees.

Fluid transition zone 57, converges towards exit plane 59, again in a conical fashion, with a generating angle ($\delta$) of same being chosen to ensure a smooth fluid flow pattern in the transition zone. A suitable range for the generating angle ($\delta$) of transition zone 57 is from about 2 to about 10 degrees.

A critical dimension of transition zone 57 is the cross sectional area at exit plane 59 of the zone, which area determines, to a high degree, aspirating properties of the nozzle, particularly when a smaller inner diameter friction tube that exhibits a high pressure drop is utilized in conjunction therewith. Cross sectional area of the exit plane 59 should be determined for maximum aspiration, such that a ratio of annular cross sectional areas of exit plane 59 to throat 55 falls in a range from about 1.3 to about 2.5.

Since it is very desirable to operate the yarn forwarding and drawing apparatus of the present invention towards minimizing the total fluid consumption, it may not be desirable to operate the device at maximum aspiration. The cross sectional area of the exit plane of the transition zone may be varied to control overall fluid consumption, while retaining satisfactory aspiration for initial yarn lace up and reintroduction of trailing filaments. FIG. 4 illustrates a further embodiment of the present device to accomplish same. A detent 158' may be provided in bottom plate 124, located adjacent an inner end of a recess like recess 58 in FIG. 2, and preferably has a diameter coincident with the outer diameter of the friction tube element 161 received within sleeve 163. An annular insert 166 may be received within recess 158', the inner surface of which defines a frustum 167 that becomes a continuation of the wall surfaces defining transition zone 157, and has an exit plane 159 having a particular cross sectional area. The exit cross sectional area of transition zone 157 may thus be quickly modified by including a particular insert 166 having the desired exit plane area for air consumption at the desired level. With insert 166 in place, an elongated friction tube 161 may be secured to the device as desired, such as the means as illustrated in FIG. 1. The exit plane 159 of transition zone 157 is then located at the juncture between insert 166 and the entrance to friction tube 161.

In general operation of the present device and process, a synthetic polymeric multifilament yarn may be extruded from a spinnerette with the yarn forwarding and drawing device generally indicated as 15 being located concentric to a central vertical axis of the spinnerette such that drag forces developed by contact between the yarn bundle and the device 15 are minimized. A pressurized primary fluid, preferably air at ambient temperature is introduced into plenum chamber 28 via ports 30 at a pressure in a range of from about 25 to about 45 p.s.i.g. and a flow rate in a range of from about 25 to about 50 s.c.f.m. Due to the design of plenum chamber 28, air turbulence therein is minimized, as is velocity of air at exit fluid port 50. Air exiting plenum chamber 28 through port 50 accelerates in velocity in acceleration zone 51 through 54 reaching sonic velocity in throat 55. Downstream of throat 55, the air reaches supersonic velocity in expansion zone 56, creating a low absolute pressure at orifice plane 45 which causes aspiration of secondary fluid (atmospheric air) through yarn passageway 42 of guide tube 41.

The filament bundle is placed generally at throat 48' of yarn inlet tube 47 where the bundle becomes entrained in the aspirated atmospheric air and is forwarded along yarn passageway 42, beyond the orifice plane 45 of same, through converging transition zone 57, and friction pipe 61 after which the filaments are deposited onto the moving support surface 70. Due to the convergence of transition zone 57, the effect of back pressure in the friction tube on aspiration is minimized, and further, in transition zone 57, primary and secondary air passes in a generally parallel flow condition, forwarding the yarn bundle along to friction tube 61. Within friction tube 61, velocity of the primary air while subsonic, exceeds that of the linear velocity of the yarn passing therethrough by an amount that frictional drag forces are produced on the yarn bundle adequate to attenuate the individual filaments while avoiding filament entanglement. The fluid operated apparatus of the present invention performs the above described forwarding and attenuation for individual filament deniers up to 15, total bundle deniers up to 1500 and linear filament velocities in a range of from about 1000 to about 7500 meters per minute with attendant advantages and improvements described herein. Subsonic primary fluid velocities up to about 13,000 meters per minute are employed.

Due to the particular arrangement of the yarn forwarding and handling device, primary and secondary air exit the nozzle structure, transition zone, and pass through the friction tube 61 in a generally parallel fashion to surround the yarn bundle and hold same off the inner side walls of friction tube 61, and avoid entanglement of the filaments, such that as the filament bundle exits friction tube 61, it is in a state of openness adequate to assure proper lay down qualities after engaging a deflector plate, or by what other means are required for depositing same onto a moving substrate.

The yarn forwarding and drawing apparatus of the present invention as mentioned above is adjustable, without a loss of concentricity of the functional elements, such that adjacent extrusion positions may be equipped, and the devices quickly and easily adjusted to ensure uniform filament physical properties in a nonwoven web produced of same, all during operation and without the necessity of overall close machining tolerances. In like fashion, component parts of one device may be interchanged with component parts of a like device, which of course adds to the overall flexibility of use of devices as described. Moreover, the devices may be manufactured of any conventional material that possesses the inherent dimensional stability, strength and rigidity to permit use of same as intended.

The following specific examples exemplify operation of the devices and process according to teachings of the present invention.

EXAMPLE 1

Polyethylene terephalate filaments (366 dtex/48) were extruded from a spinnerette at a polymeric flow rate of 220.8 grams per minute. A forwarding and drawing device of the type illustrated in FIG. 2 was positioned approximately 1.8 meter below the face of the spinnerette, concentric to a vertical center line through the spinnerette. A friction tube was attached to the jet body, the tube having an inner diameter of 12.7 millimeters and a length of 3.35 meters. A rotating deflector plate was located beteen the exit end of the junction pipe and a conveyor belt on which filaments were deposited. Pressurized air (43 p.s.i.g.) was introduced to the plenum chamber at a flow rate of 47.4 scfm. The filaments were introduced to the throat of the yarn inlet where the bundle was entrained in atmospheric air aspirated into the yarn passageway. Parallel air flow conditions generally existed and the filament bundle moved through the friction tube at a linear velocity of about 6028 meters/minute where air velocity was about 10,500 meters per minute. The filament bundle exhibited openness at the exit from the friction tube. When tested, the filaments exhibited a tenacity of 3.3 cN/dtex and an elongation of 55.7 percent.

EXAMPLES 2-8

Example 1 was repeated with the exception that process conditions differed according to the information set forth in Table I below. For those parameters not listed in Table I, conditions were the same as listed in Example 1.

TABLE I

| Example No. | Filament Count, (dtex/f) | Polymer Throughput, gm./min. | Friction pipe dia., (mm) | Supply Air Pressure, p.s.i.g. | Supply Air Flow rate, scfm | Yarn Take up Speed, (m/min) | Air Velocity, (m/min) | Yarn Tenacity cN/dtex | Yarn Elongation % |
|---|---|---|---|---|---|---|---|---|---|
| 2 | 345/48 | 220.8 | 12.9 | 43.0 | 47.4 | 6399 | 10,269 | 3.76 | 49.0 |
| 3 | 388/48 | 238.6 | 12.1 | 45.0 | 49.0 | 6150 | 12,069 | 2.71 | 47.5 |
| 4 | 396/48 | 238.6 | 12.1 | 45.0 | 43.0 | 6027 | 10,592 | 3.08 | 47.5 |
| 5 | 410/90 | 238.5 | 12.1 | 45.0 | 49.0 | 5820 | 12,069 | 3.14 | 55.5 |
| 6 | 417/90 | 238.5 | 12.1 | 37.7 | 43.2 | 5723 | 10,640 | 3.09 | 59.5 |
| 7 | 228/50 | 159.4 | 12.7 | 45.0 | 49.2 | 7000 | 10,997 | 3.01 | 46.0 |
| 8 | 268/50 | 187.2 | 12.7 | 45.0 | 50.0 | 6975 | 11,180 | 3.47 | 49.0 |

In each of Examples 2 through 8, measured yarn characteristics are within specification ranges. These examples thus illustrate operability of the device and process of the present invention at various levels.

Having described the present invention in detail, it is obvious that one skilled in the art will be able to make variations and modifications thereto without departing from the scope of the invention. Accordingly, the scope of the present invention should be determined only by the claims appended thereto.

That which we claim is:

1. A fluid operated forwarding and drawing apparatus for continuous thermoplastic filament yarns comprising:

(a) a body, said body defining a fluid plenum chamber therein, said body further defining fluid inlet ports and a generally funnel shaped outlet port in communication with said plenum chamber and a bore opening in communication with said plenum chamber and located concentric to a central axis through said fluid outlet port;

(b) yarn guide means received in said bore opening and terminating in said generally funnel shaped fluid outlet port of said plenum chamber, said guide means defining a yarn passageway therethrough, said passageway being concentric to said central axis, a portion of the length of said guide means having a generally frustoconical taper to a forward tip of said means, said frustoconically tapered portion of said means cooperating with said generally funnel shaped fluid outlet port to define a nozzle structure having a fluid acceleration zone, a throat, and a diverging expansion zone, and said outlet port further defining a converging fluid transition zone beyond the tip of said yarn guide means; and (c) an elongated tubular element located at an outer end of said converging transition zone and defining a yarn passageway of constant diameter therethrough, the diameter of said elongated tubular element being greater than the diameter of the transition zone at the exit from same, said yarn passageway abutting said outlet end of said transition zone, whereby filaments of a filament bundle are forwarded and drawn by said apparatus while avoiding any significant entanglement in said elongated tubular element or significant contact with walls defining same.

2. Apparatus as defined in claim 1 wherein said fluid inlet ports are spaced equidistantly around said body.

3. Apparatus as defined in claim 2 wherein surfaces defining said plenum chamber are smoothly contoured, whereby fluid turbulence in the plenum chamber is reduced.

4. Apparatus as defined in claim 1 wherein said yarn guide means is adapted for axial adjustment with respect to said fluid outlet port without loss of concentricity to said central axis through said fluid outlet port, whereby the positional relationship between said tapered portion of said guide means and said outlet port may be changed to vary operational parameters of said apparatus.

5. Apparatus as defined in claim 4 wherein surfaces along at least a portion of the length of said bore opening and said yarn guide means are ground within close tolerances, adequate to permit axial movment of said yarn guide means along said bore opening while avoiding loss of concentricity of said yarn guide means with respect to said central axis through said fluid outlet port.

6. Apparatus as defined in claim 5 wherein further portions of said bore opening and said yarn guide means are provided with complementary threads whereby said yarn guide means may be threadably moved along said bore opening.

7. Apparatus as defined in claim 6 wherein locking means are associated with said yarn guide means and said body to secure said guide means in place with respect to said body.

8. Apparatus as defined in claim 4 wherein said yarn guide means includes a yarn inlet means located at an outer end of same, said inlet means defining a generally funnel shaped yarn contact surface.

9. Apparatus as defined in claim 8 wherein said yarn inlet means is threadably connected to an element of said yarn guide means, said contact surface being trumpet shaped.

10. Apparatus as defined in claim 1 wherein said body comprises an upper portion and a bottom plate, said upper portion defining a portion of said plenum chamber, said fluid inlet ports and said bore opening, and said bottom plate defining a bottom wall of said plenum chamber and said generally funnel shaped fluid outlet port of said plenum chamber, said plate being adjustably secureable to said upper portion of said body to permit precise location of said fluid outlet port to locate said central axis concentric to said bore opening.

11. Apparatus as defined in claim 10 further comprising an annular insert receivable between said plate and said elongated tubular element and concentric to said central axis through said fluid outlet port, whereby the operational parameters of said apparatus may be determined by the internal diameter and internal shape of said annular insert.

12. Apparatus as defined in claim 1 wherein the ratio of the open cross sectional areas of the outlet to the inlet of the expansion zone is no smaller than about 2.0.

13. Apparatus as defined in claim 1 wherein the ratio of open cross sectional areas of the exit end of the transition zone to the throat is in a range of from about 1.3 to about 2.5.

14. Apparatus as defined in claim 1 wherein the generating angle of the generally funnel shaped fluid outlet port is in a range of from about 10 to about 40 degrees.

15. Apparatus as defined in claim 14 wherein the funnel shaped fluid outlet port is more particularly defined as a trumpet shape where an angle ($\alpha$) defined by a line tangent to the trumpet at the throat and said central axis is in a range of from about 10 to about 30 degrees and the generating angle ($\beta$) of the frustoconical taper of the yarn guide means is in a range of from about 5 to about 15 degrees.

16. Apparatus as defined in claim 15 wherein the resulting convergence angle of the acceleration zone of the nozzle ($\alpha$-$\beta$) is no larger than about 20 degrees.

17. Apparatus as defined in claim 15 wherein the generating angle ($\gamma$) of the walls of said port within the expansion zone is less than the generating angle ($\beta$) of the yarn guide means, and is no greater than 10 degrees.

18. Apparatus as defined in claim 17 wherein the generating angle ($\delta$) of the transition zone is in a range of from about 2 to about 10 degrees.

19. Apparatus as defined in claim 15 wherein the trumpet shape to the fluid outlet port defines a plurality of annular segments in the fluid acceleration zone, adjacent segments being joined at an annular edge, whereby smooth fluid acceleration is promoted along with parallel fluid flow to the throat.

20. A fluid forwarding and drawing apparatus for forwarding and attenuating a bundle of thermoplastic filaments while avoiding entanglement of the filaments comprising:

(a) a body, said body defining a fluid plenum chamber therein having fluid inlet ports equally spaced thereabout and a generally funnel shaped outlet port, said body further defining a bore opening in communication with said plenum chamber, said bore opening being concentric to a central axis through said fluid outlet port of said plenum chamber;

(b) tubular yarn guide means received in said bore opening and extending into said plenum chamber, a tip of said yarn guide means terminating in said fluid outlet port, said guide means defining a yarn passageway therealong, said yarn passageway being concentric to said central axis through said fluid outlet port, said guide means further having a frustoconical tapered outer surface along at least a portion of the length of same down to said tip, said frustoconical tapered end of said guide means cooperating with said generally funnel shaped fluid outlet port to define a fluid nozzle structure, said nozzle structure having a fluid acceleration zone that terminates at a throat and a diverging fluid expansion zone immediately downsteam of said throat, said tip of said yarn guide means terminating at an exit end of said expansion zone, and said port further defining a converging fluid transition zone at the exit end of said expansion zone, the ratio of cross sectional areas at the expansion zone to the inlet end of the expansion zone being no smaller than about 2.0; and (c) an elongated friction tube secured to said body at said fluid outlet port, said friction tube being concentricly located to said central axis through said outlet port and an inlet to said friction tube abutting the exit of said transition zone, the internal diameter of said friction tube being constant and larger than the diameter of the exit of the transition zone whereby substantial tensioning will occur on filaments passing therethrough, and whereby filaments of said bundle are forwarded and drawn by said apparatus while avoiding any significant entanglement in said friction tube or significant contact with walls defining same.

21. Apparatus as defined in claim 20 wherein the ratio of the cross sectional areas of the outlet from the transition zone to the throat is in a range of from about 1.3 to about 2.5.

22. Apparatus as defined in claim 21 wherein said plenum chamber has a conical sleeve extending into same, said yarn guide means passing through said sleeve.

23. Apparatus as defined in claim 21 wherein an angle ($\alpha$) generated between a line tangent to the port wall in the acceleration zone at the throat and the central axis through the outlet port is in a range of from about 10 to about 30 degrees, a generating angle ($\beta$) of the frustoconical portion of the yarn guide means is in a range of from about 5 to about 15 degrees, a generating angle ($\gamma$) of the port walls within the expansion zone is less than the generating angle ($\beta$) and does not exceed about 10 degrees, and a generating angle ($\delta$) of the transition zone is in a range of from about 2 to about 10 degrees.

24. Apparatus as defined in claim 23 wherein said body comprises an upper portion and a bottom plate portion, said bottom plate portion defining at least a portion of a bottom wall of said plenum chamber and said fluid outlet port.

25. Apparatus as defined in claim 23 wherein said yarn guide means is adapted for axial movement with respect to said outlet port while avoiding loss of concentricity of said yarn passageway to said central axis through said outlet port, whereby the operating performance of the fluid nozzle may be adjusted.

26. Apparatus as defined in claim 25 wherein said apparatus further comprises an annular insert received on said body at said exit to said fluid outlet port, said insert having a predetermined inner diameter to provide a predetermined cross sectional area at the exit to the transition zone, an outer diameter of said insert being equal to the outer diameter of said friction tube, and said entrance of said friction tube abutting an exit of said insert.

27. Apparatus as defined in claim 25 wherein said yarn guide means is threadably associated with said body for axial adjustment and wherein a portion of the surface of the guide means and mating surfaces of said bore opening are ground within tolerances close enough to permit the axial movement of the yarn guide means while retaining concentricity of same with respect to said central axis.

28. Apparatus as defined in claim 25 wherein said yarn guide means has a funnel shaped yarn inlet surface at an outer end of same.

29. Apparatus for forwarding and drawing synthetic polymeric filamentary materials comprising:

(a) means defining a plenum chamber for fluid under pressure;

(b) means for introducing a primary fluid under pressure into said chamber in a generally nonturbulent fashion;

(c) means defining a fluid nozzle at an outlet from said fluid chamber; said nozzle being a ring nozzle and having a fluid acceleration zone, a throat, a diverging fluid expansion zone and a converging fluid transition zone adapted for generally parallel flow of primary fluid therein;

(d) a portion of said nozzle defining means including means for introducing synthetic polymeric filamentary materials to said nozzle whereby fluid under pressure at said nozzle acts on said filamentary materials introducing means to aspirate a flow of secondary fluid therethrough; and (e) means downstream of said nozzle for tensioning said filamentary materials adequate to cause attenuation of said filamentary materials at a point before said materials are introduced into said apparatus, said downstream means defining a yarn passageway of constant diameter therethrough, the internal diameter of said downstream means being larger than the diameter of the transition zone at the exit from same, and all of said means being concentric to a central axis through said fluid nozzle, whereby filamentary materials are forwarded and drawn by said apparatus while avoiding any substantial entanglement in said downstream tensioning means or significant contact with walls defining same.

30. Apparatus as defined in claim 29 wherein said means for introducing filamentary materials to said nozzle comprise an elongated tubular element defining a yarn passageway therealong and having a frustoconically tapered end, said end cooperating with a portion of said fluid chamber outlet to define said nozzle.

31. Apparatus as defined in claim 30 wherein said elongated tubular element is movable in an axial direction with respect to a central axis through said chamber outlet whereby operating conditions of said nozzle may be varied.

32. Apparatus as defined in claim 29 wherein said means defining said plenum chamber comprise a body, said body comprising an upper body portion defining a portion of said plenum chamber, fluid inlet ports to said plenum chamber and a central bore opening that communicates with said plenum chamber, and a bottom plate adjustably secureable to said upper body portion, said bottom plate defining a bottom wall for said plenum chamber and said outlet from said chamber.

33. Apparatus as defined in claim 29 wherein said means for tensioning said filamentary materials comprises an elongate tubular element defining a yarn passageway therethrough, the relative velocities of primary fluid to said filamentary materials being such therein that friction forces are developed on said filamentary materials adequate to cause said attenuation.

34. Adjustable fluid operated forwarding and drawing apparatus for organic thermoplastic filamentary materials comprising:

(a) a body, said body having an upper body portion and a lower body portion secureable thereto, said body portions cooperating to define a fluid plenum chamber therewithin, at least one of said body portions further defining a plurality of fluid inlet ports in communication with said plenum chamber, a fluid outlet port and a bore opening in connection with said plenum chamber, one of said body portions being laterally adjustable with respect to said other body portion such that said bore opening and said fluid outlet port can be aligned concentric to a center line passing therethrough;

(b) filamentary material inlet means received along said bore opening and defining a material passageway therealong, one end of said inlet means passing through said plenum chamber and being concentric to said center line and a tip of said inlet means residing at said outlet port, said end and tip of said inlet means cooperating with said outlet port to define a fluid nozzle structure thereat, said nozzle structure including a converging fluid acceleration zone, a throat, a diverging expansion zone, and a converging transition zone, said inlet means being adapted for axial movement with respect to said outlet port while avoiding a loss of concentricity whereby the operating parameters of said nozzle structure may be varied; and (c) friction tube means secured to said body at said outlet port, said friction tube means defining a material passageway therealong of constant inner diameter and said diameter being larger than the diameter of the exit of said transition zone, whereby filamentary materials undergo adequate frictional force therein to cause drawing of same, said passageway being concentric to said center line.

35. Apparatus as defined in claim 34 wherein an upper body portion defines a portion of said plenum chamber, said fluid inlet ports and said bore opening and a bottom body portion defines a wall of said plenum chamber and said fluid outlet port, said bottom body portion being adjustable with respect to said upper body portion whereby said outlet port can be aligned concentric to said center line.

36. Apparatus as defined in claim 35 wherein said material inlet means comprises an elongated tubular element received in said bore opening, said tubular element defining said yarn passageway, said element having a generally frustoconically tapered end in said plenum chamber and said outlet port and an end of said element without said body having a generally funnel shaped yarn contact surface that is in communication with said material passageway.

37. Apparatus as defined in claim 36 wherein said tubular element and said bore opening having ground surfaces along a portion of the length of same, said surfaces being ground within tolerances adequate to permit axial movement of said tubular element while avoiding loss of concentricity.

38. Apparatus as defined in claim 37 wherein said tubular element and said bore opening have mating threaded sections along a portion of the length of same whereby said tubular element may be threadedly moved along said bore opening to adjust operating parameters of said nozzle structure.

39. Apparatus as defined in claim 36 wherein said tip of said element determines a juncture between an exit end of said expansion zone and an inlet to said transition zone.

40. Apparatus as defined in claim 39 wherein an exit end of said transition zone abuts an entrance end of said friction tube means.

* * * * *